US008127544B2

(12) United States Patent
Schwiesow et al.

(10) Patent No.: US 8,127,544 B2
(45) Date of Patent: Mar. 6, 2012

(54) TWO-STROKE HCCI COMPOUND FREE-PISTON/GAS-TURBINE ENGINE

(76) Inventors: Paul Albert Schwiesow, Arvada, CO (US); Ronald Lee Schwiesow, Boulder, CO (US); Dino Tomassetti, Jr., Belle Harbor, NY (US)

( * ) Notice: Subject to any disclaimer, the term of this patent is extended or adjusted under 35 U.S.C. 154(b) by 0 days.

(21) Appl. No.: 12/939,149

(22) Filed: Nov. 3, 2010

(65) Prior Publication Data

US 2011/0239642 A1 Oct. 6, 2011

(51) Int. Cl.

| | |
|---|---|
| ***F02B 71/04*** | (2006.01) |
| ***F02B 33/44*** | (2006.01) |
| ***F02B 75/04*** | (2006.01) |
| ***F02B 71/00*** | (2006.01) |
| ***F02B 75/22*** | (2006.01) |
| ***F02B 75/20*** | (2006.01) |
| ***F02G 3/00*** | (2006.01) |

(52) U.S. Cl. ..... 60/595; 60/598; 60/614; 60/624; 123/46 R; 123/46 E; 123/55.7; 123/58.3

(58) Field of Classification Search ..... 60/595–596, 60/597–598, 614, 624, 39.6; 123/46 A, 46 R, 123/46 E, 50 B, 53.1, 53.3, 55.7, 58.3, 59.7
See application file for complete search history.

(56) References Cited

U.S. PATENT DOCUMENTS

| | | | | | |
|---|---|---|---|---|---|
| 1,356,576 | A | * | 10/1920 | Wickersham | 123/58.3 |
| 1,399,666 | A | * | 12/1921 | Short | 123/55.7 |
| 1,405,551 | A | * | 2/1922 | Nichols | 60/595 |
| 1,785,643 | A | | 1/1930 | Noack et al. | |
| 1,980,924 | A | * | 11/1934 | McDonald | 123/55.7 |
| 2,625,006 | A | * | 1/1953 | Lundquist | 60/624 |
| 2,783,750 | A | * | 3/1957 | Horgen | 123/46 R |
| 2,814,551 | A | * | 11/1957 | Broeze et al. | 123/46 R |
| 2,914,909 | A | | 12/1959 | Kubik | |
| 2,963,008 | A | | 12/1960 | Waldrop | |
| 2,983,098 | A | * | 5/1961 | Bush | 60/595 |
| 3,005,306 | A | * | 10/1961 | Bush | 60/595 |
| 3,007,302 | A | * | 11/1961 | Vincent | 60/624 |
| 3,042,011 | A | * | 7/1962 | Fenton-Smith | 123/50 B |
| 3,238,713 | A | * | 3/1966 | Wallace | 60/624 |

(Continued)

FOREIGN PATENT DOCUMENTS

DE 3229940 A1 * 6/1984

(Continued)

OTHER PUBLICATIONS

Horton, J. "Amazing New Lightweight Turbine." Mechanix Illustrated (Feb. 1969): 66-68; 134-136. Attached as Horton_mechanix_illustrated_article.pdf.

(Continued)

*Primary Examiner* — Thai Ba Trieu
(74) *Attorney, Agent, or Firm* — Jennifer L. Bales; Macheledt Bales LLP

(57) ABSTRACT

This invention provides a compact, fuel-efficient internal combustion engine that can be used to provide rotating shaft output power to a wide variety of mobile and stationary applications. It is based on a two-stroke free-piston gas generator that implements the homogeneous charge compression ignition (HCCI) combustion principle for essentially constant-volume combustion, and it employs a variable piston stroke to maintain a high level of efficiency across a wide range of loads and speeds. A rotary device, which may be of either an aerodynamic or positive displacement type, converts the energetic gas stream to power at a rotating shaft.

10 Claims, 9 Drawing Sheets

U.S. PATENT DOCUMENTS

| | | | | | |
|---|---|---|---|---|---|
| 3,347,215 | A | * | 10/1967 | Pescara | 123/46 R |
| 3,365,879 | A | * | 1/1968 | Panhard | 60/595 |
| 3,498,053 | A | * | 3/1970 | Johnston | 60/624 |
| 3,525,102 | A | * | 8/1970 | Braun | 123/46 R |
| 4,013,048 | A | | 3/1977 | Reitz | |
| 4,205,528 | A | * | 6/1980 | Grow | 60/595 |
| 4,385,597 | A | | 5/1983 | Steltzer | |
| 4,481,772 | A | | 11/1984 | Benaroya | |
| 4,719,756 | A | * | 1/1988 | Streuli | 60/624 |
| 4,748,812 | A | * | 6/1988 | Okada et al. | 60/624 |
| 4,760,702 | A | * | 8/1988 | Ammann et al. | 60/624 |
| 4,776,166 | A | * | 10/1988 | Dixon | 60/595 |
| 4,800,726 | A | * | 1/1989 | Okada et al. | 60/614 |
| 4,843,822 | A | * | 7/1989 | Okada | 60/614 |
| 4,858,440 | A | * | 8/1989 | Okada | 60/614 |
| 4,873,822 | A | * | 10/1989 | Benaroya | 60/595 |
| 4,907,548 | A | * | 3/1990 | Lee | 123/197.3 |
| 5,119,633 | A | * | 6/1992 | Brooks et al. | 60/624 |
| 5,138,840 | A | * | 8/1992 | Oguchi et al. | 60/624 |
| 5,287,827 | A | * | 2/1994 | Almendinger et al. | 123/46 R |
| 6,199,519 | B1 | | 3/2001 | Van Blarigan | |
| 6,609,582 | B1 | | 8/2003 | Botti et al. | |
| 6,681,575 | B2 | * | 1/2004 | Dellora et al. | 60/624 |
| 6,748,907 | B2 | * | 6/2004 | Malmquist et al. | 123/46 E |
| 6,959,672 | B1 | * | 11/2005 | Peng et al. | 123/46 R |
| 6,983,724 | B2 | | 1/2006 | Carlson | |
| 7,047,916 | B2 | * | 5/2006 | Pischinger et al. | 123/46 R |
| 7,100,546 | B2 | | 9/2006 | Sorochkin et al. | |
| 7,194,989 | B2 | * | 3/2007 | Hallenbeck | 123/56.1 |
| 7,258,086 | B2 | | 8/2007 | Fitzgerald | |
| 7,318,506 | B1 | * | 1/2008 | Meic | 123/46 R |
| 7,347,048 | B2 | * | 3/2008 | Albat | 60/624 |
| 7,775,044 | B2 | * | 8/2010 | Julien et al. | 60/614 |
| 7,845,317 | B2 | * | 12/2010 | Max et al. | 123/46 E |
| 2005/0247272 | A1 | * | 11/2005 | Carlson | 123/46 R |
| 2008/0036312 | A1 | * | 2/2008 | Max et al. | 290/1 R |

FOREIGN PATENT DOCUMENTS

| | | | | |
|---|---|---|---|---|
| DE | 3330315 | A1 | * | 3/1985 |
| DE | 3415550 | A1 | * | 11/1985 |
| FR | 2441073 | A | * | 7/1980 |
| GB | 2214569 | A | * | 9/1989 |
| JP | 62013722 | A | * | 1/1987 |
| JP | 63068711 | A | * | 3/1988 |

OTHER PUBLICATIONS

Horton, J. Building notes for the "Loud Mouth" free-piston jet engine (untitled). Direct send from designer. See particularly cover page, last paragraph; p. 1, first paragraph; and p. 2, first through third full paragraphs. Attached as Horton_building_notes.pdf.

Horton, J. Assembly drawings for the "Loud Mouth" free-piston jet engine. Direct send from designer. See particularly assembly drawings A, B, and C. Attached as Horton_assembly_drawings.pdf.

Underwood, A. F. "The GMR 4-4 'Hyprex' Engine: A Concept of the Free-Piston Engine for Automotive Use," SAE Transactions 65 (1957): 377-391. See particularly pp. 378, 379, and 380, fig. 3. Attached as Underwood_SAE_paper_570032.pdf.

Energy Efficiency and Renewable Energy, Office of Transportation Technologies. "Homogeneous Charge Compression Ignition (HCCI) Technology: A Report to the U.S. Congress, Apr. 2001." U.S. Department of Energy, Washington, D.C., 2001 See Executive Summary (pp. 1-5) for characteristics of HCCI combustion and the current state of the art for crank-piston engines. Attached as HCCI_technology_doe_paper.pdf.

Mikalsen, R. et al. "A review of free-piston engine history and applications." Applied Thermal Engineering 27 (Oct. 2007): Issues 14-15, 2339-2352. See particularly p. 3, section 2.2.4 and p. 10, section 4.2 for a description of early gas generators. Review headings starting on p. 9, section 4 and note that no reference is made to a gas generator-turbine combination as a current HCCI free-piston engine configuration. Attached as Mikalsen_FPEreview.pdf.

Mikalsen, R. and A.P. Roskilly. "A review of free-piston engine history and applications." Applied Thermal Engineering 27 (Oct. 2007): Issues 14-15, 2339-2352. Attached as Mikalsen_FPEreview.pdf. See p. 2, section 2.2.2, which indicates that recent double-acting FP engines have been limited to hydraulic and electric power output, and p. 3, section 2.2.4 and p. 10, section 4.2, which indicate that early gas generators were neither double-acting nor HCCI. Note the comment at the bottom of p. 12 indicating that the Kvaerner engine, which is neither double-acting nor.

Widener, S.K. "A Survey of Technology for Hybrid Vehicle Auxiliary Power Units." ARPA Interim report TFLRF No. 311 (1995). Attached as ARPA_survey.pdf. See pp. 27-32 for early FP-gas turbine engines; 32- 34 for FP hydraulic and pneumatic pumps; 36-38 for (non-HCCI) FPEs as linear alternators; 38-39 for (non-HCCI, two-piston opposed) FP gas generators with turboalternators; 42-43 for crank-piston HCCI developments with no reference to FP engines; and 46 for (non-HCCI) 2-stroke crank piston engines used as gas generators for turboalternators. Note that there is no.

Energy Efficiency and Renewable Energy, Office of Transportation Technologies. "Homogeneous Charge Compression Ignition (HCCI) Technology: A Report to the U.S. Congress, Apr. 2001." U.S. Department of Energy, Washington, D.C., 2001. Attached as HCCI_technology_doe_paper.pdf. See Executive Summary (pp. 1-5) for characteristics of HCCI combustion and the current state of the art for crank-piston engines.

Underwood, A. F. "The GMR 4-4 'Hyprex' Engine: A Concept of the Free-Piston Engine for Automotive Use," SAE Transactions 65 (1957): 377-391. Attached as Underwood_SAE_paper_570032.pdf. See particularly pp. 378, 379, and 380, fig. 3 for a summary of FP-gas turbine advantages in an opposed-piston configuration.

Horton, J. Building notes for the "Loud Mouth" free-piston jet engine (untitled). Direct send from designer. See particularly cover page, last paragraph; "p. one," first and third paragraphs; "p. two," first through third full paragraphs; "p. 3," fourth paragraph, and last page, "About Nozzles," first two paragraphs under "Several Late Tips." Attached as Horton_building_notes.pdf.

Horton, J. Assembly drawings for the "Loud Mouth" free-piston jet engine. Direct send from designer. See particularly assembly drawings A, B, C, and D. Attached as Horton_assembly_drawings.pdf.

* cited by examiner

TWO-STROKE HCCI COMPOUND FREE-PISTON/GAS-TURBINE ENGINE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM, LISTING COMPACT DISC APPENDIX

Not Applicable

BACKGROUND OF THE INVENTION

This invention pertains to thermodynamically efficient internal combustion engines, particularly U.S. Patent Classifications 123/46R (free piston engines), 123/46A (free piston engines with two chambers and one piston), 123/46B (free piston engines-phasing means between two or more units) and 60/595 (power plants in which a free piston device supplies motive fluid to a motor). In addition to the field of free-piston engines, the invention is relevant to internal combustion engines employing homogeneous charge compression ignition (HCCI). It is also relevant to the efficient operation of internal combustion gas turbine engines. In one embodiment employing compressed air starting, the invention pertains to U.S. Patent Classification 60/596 (power plants using a free piston device with a pressure fluid starting means).

Two-stroke free-piston engines used in combination with a rotary, gas-driven motor (often referred to as "compound free piston-gas turbine engines," of which the present invention is a subtype) are known and have been proposed as a means of improving fuel efficiency, reducing cost, and adding multifuel capability to conventional gas turbine engines. Such compound engines have also been proposed as a means of improving fuel efficiency, increasing power density, improving low-speed torque, reducing cost and complexity, and adding multifuel capability to conventional crank-piston internal combustion engines. Most early designs employed a free-piston combustor (gas generator) of the "two-piston opposed" type to generate pressurized gas, and used the pressurized gas to rotate an axial power turbine, as instanced by A. F. Underwood, "The GMR 4-4 'Hyprex' Engine: A Concept of the Free-Piston Engine for Automotive Use," SAE Transactions 65 (1957): 377-391. Known prototypes demonstrated an ability to run on a wide variety of liquid fuels, had very low vibration, and exhibited excellent low-speed torque. However, they proved to have fundamental structural weaknesses and were very bulky and heavy. Fuel efficiency was reported to be roughly equal to or slightly better than that of conventional crank piston engines.

A proposed improvement to the "two-piston opposed" model for compound free piston-gas turbine engines might be described as a "single-piston" or "single piston assembly" model, as instanced by U.S. Pat. No. 1,785,643, U.S. Pat. No. 2,963,008, and U.S. Pat. No. 4,205,528. These and similar designs incorporate a free-piston combustor (gas generator) in which a single, double-ended piston, or alternatively a single assembly consisting of two pistons fixedly attached to each other via a rigid connecting rod, oscillates back and forth in either a single cylinder or two coaxial cylinders, with combustion occurring at alternate cylinder ends (heads). The pressurized gas thus produced is used to rotate a power turbine to do useful work, while the piston motion itself is used solely to produce compression in the cylinder end opposite each combustion event. Such designs claim greatly increased operating frequency of the free-piston combustor (gas generator), as well as superior structural strength, greater simplicity, and dramatically reduced weight and size, relative to the "two-piston opposed" model.

Within the past twenty years, free piston engines of the single piston/single piston assembly type have been proposed as a means of obtaining homogeneous charge compression ignition (HCCI), which offers advantages over conventional combustion models in terms of near-instantaneous burn rate (hence nearly ideal constant volume combustion), the enabling of high compression ratios, the ability to run unthrottled at very lean mixtures, multifuel capability, and reduced particulate and NOx emissions. Free-piston engines, and more particularly free-piston engines of the single piston/single piston assembly type, are a natural fit for HCCI combustion: because such engines have inherently variable stroke, a compressing force may be applied indefinitely to a homogeneous charge of any temperature and equivalence ratio until the charge auto-ignites, and, because piston motion is unconstrained, the exact moment of combustion need not be controlled. This is in marked contrast to existing crank-piston HCCI engines, in which engine temperature, temperature of the intake charge, and equivalence ratio must be carefully monitored and controlled to ensure that spontaneous ignition occurs at or near top dead center of piston motion. Crank-piston HCCI engines additionally face the potential for rods and cranks to be damaged by the high pressure peaks characteristic of HCCI combustion: because of this, they are typically run at very lean mixtures and constant low loads. Free piston engines, by contrast, have no conventional rods or cranks, and can thus theoretically be operated across a wide power range at mixtures up to and including the stoichiometric ratio without damage to engine components.

While several recent designs utilize HCCI combustion in a two-stroke free-piston engine of the single piston/single piston assembly type (e.g., U.S. Pat. No. 6,199,519 and U.S. Pat. No. 6,959,672), none employs the engine as a combustor (gas generator) where the energetic output gas is used to drive a rotary motor. The first example above is configured as an electrical linear alternator, for instance, while the second assumes a configuration as either an electrical linear alternator or a hydraulic or pneumatic pump. All other known configurations of two-stroke, HCCI free-piston engines of the prior art incorporate one of these three power extraction methods. These configurations fail to take full advantage of the free-piston model for HCCI operation: because they attempt to extract useful work from the piston motion, piston speed and momentum are reduced, and the engine's ability to generate a compressing force sufficient for auto-ignition of the charge is thereby rendered problematic. In practice, most such engines require complex sensing and control mechanisms to balance compression force with power extraction forces, and they have thus been confined to constant-load operation. Also, because extracting work from piston motion reduces the maximum attainable operating frequency of the engine, such engines have exhibited poor power density. A superior solution is suggested by utilizing a power turbine or rotary gas-driven motor for power extraction in two-stroke free-piston HCCI engines of this type, but there is no known instance of such a design in the prior art.

The prior art does contain at least one instance of a two-stroke, HCCI, free-piston combustor (gas generator) in isolation, namely that described by J. Horton ("Amazing New Lightweight Turbine," Mechanix Illustrated [February, 1969]: 66-68; 134-136). Because it is configured as a pure jet with no attempt made to extract work from the piston motion, the Horton engine enjoys several advantages over a similar engine configured as a linear alternator or hydraulic or pneumatic pump, including simplicity (no sensing or control mechanisms are required, and the engine has three moving parts), extremely high operating frequency, and very light weight. However, since the Horton engine is a pure jet, it has a limited range of applications (for instance, it is unsuitable for a land vehicle operated in traffic). Additionally, the Horton engine is reported to suffer from extreme noise, as well as from typical two-stroke disadvantages of needing to add lubricant to the fuel and of short-circuiting raw fuel out the exhaust. Finally, the Horton engine employs an engine geometry that requires very precise machining and that is nonetheless vulnerable to leakage and binding. All of these challenges are addressed by the currently preferred embodiment of the present invention.

Special mention should be made of two additional patents: U.S. Pat. No. 1,785,643 (referenced earlier) and U.S. Pat. No. 7,258,086. U.S. Pat. No. 1,785,643 (Noack et al.) describes a single-piston assembly, two-stroke, compound free piston-gas turbine engine in which an integral, reciprocating linear electric motor/generator is coupled to a rotary generator in order to obtain favorably-phased oscillation rates of the piston assemblies in multiple free-piston combustors (gas generators). While the Noack engine did not utilize HCCI combustion, the use of a linear motor/generator to obtain these favorably-phased oscillation rates is similar to that put forward in an alternative embodiment of the present invention, which will be described later in greater detail. U.S. Pat. No. 7,258,086 (Fitzgerald) describes a four-cylinder, four-stroke, HCCI, compound free piston-gas turbine engine as one alternative embodiment. While this stated embodiment shares several operating principles with the currently preferred embodiment of the present invention, numerous distinctions arise from the unique architecture required to support four-stroke vs. two-stroke operation. Relative to the compound free piston-gas turbine embodiment claimed in U.S. Pat. No. 7,258,086, the currently preferred embodiment of the present invention: 1) uses half the number of pistons and cylinders to obtain the same number of power strokes; 2) eliminates a moving piston linkage; 3) utilizes simple ports rather than a positive valving system; 4) employs an under-piston chamber to provide scavenging pressure rather than employing a separate intake stroke; 5) employs closed-cylinder fuel injection in preference to open; 6) employs a novel, closed-circuit lubrication system, and 7) provides for the optional substitution of a positive-displacement gas-driven motor and/or centrifugal turbine in place of the "power turbine" named in the Fitzgerald embodiment. A four-stroke architecture is one valid means of addressing common two-stroke problems of a narrow power band, poor fuel efficiency, and high emissions; however, the currently preferred embodiment of the present invention utilizes alternative means to address these problems and eschews a four-stroke architecture in favor of the higher operating frequency, improved power density, decreased complexity and cost, and reduced friction inherent in its two-stroke configuration.

BRIEF SUMMARY OF THE INVENTION

The present invention is based on the type of two-stroke, single-piston assembly, compound free piston-gas turbine engine design described in the prior art. That is, it consists of at least a free-piston combustor (gas generator) to compress, combust, and partially expand a charge, and a rotary device that uses the energetic, hot gas thereby obtained to turn an output power shaft. In contrast to the prior art regarding such compound engines, the present invention employs homogeneous charge compression ignition (HCCI) as the combustion model: this is done to take advantage of the superiority of HCCI over other combustion models in terms of thermodynamic efficiency, multifuel capability, and reduced emissions. The currently preferred embodiment includes a rotary supercharger or turbocharger to provide initial compression of input air to the free-piston engine; an additional embodiment allows for the substitution of a positive-displacement gas-driven motor and/or centrifugal turbine in place of the axial- or impulse-type power turbines of the prior art. In order to start the engine, compressed air means and a conventional ignition system are employed; an alternative embodiment puts forth an integral linear electric motor/alternator to start the engine and, in the event that multiple free-piston combustors (gas generators) are used, to obtain favorably-phased oscillation rates of the piston assemblies of such combustors (gas generators).

One way of looking at the configuration of the present invention is to consider it similar to a conventional gas turbine engine (turboshaft) in which the higher-pressure stages of the compressor, the combustor can(s), and the first stages of the compressor turbine have been replaced by the free-piston combustor (gas generator). By using the positive displacement device of free pistons to quickly and efficiently attain compression rather than using the inefficient dynamic device of multiple rotating compressor stages, and by employing intermittent, closed, near-ideal constant-volume combustion in preference to continuous, open-ended, constant-pressure combustion, the present invention operates at a much higher thermodynamic efficiency than a conventional gas turbine engine.

An alternative way of looking at the present invention is to consider it similar to a supercharged or turbocharged two-stroke crank-piston engine with the crank and connecting rods removed. This allows for easy accommodation of HCCI combustion, which is more thermodynamically efficient than either compression-ignition direct-inject ("diesel") or homogeneous-charge spark-ignition ("petrol") combustion modes. Freeing the pistons to operate with the sole constraints of fluid and inertial forces places the structure of the engine under much less stress than crank-piston configurations; it also decouples the frequency of combustion from the rotational speed of the output shaft, allowing for higher operating frequencies, improved power density, rapid delivery of full power from idle, and the development of extremely high torque at low shaft output speeds.

Operation

The operation of the free-piston combustor (gas generator) portion of the currently preferred embodiment greatly reduces the complications of the prior art. It has one primary moving part: a single assembly consisting of two pistons fixedly attached to each other via a rigid connecting rod, oscillating in a single cylindrical "casing" closed at each end and divided into two functionally separate cylinders by a central, axially fixed, disk-shaped divider element. The only other moving parts are two passive reed valves controlling the intake air flow and two in-cylinder fuel injectors. (Both of these last elements are optional, but are utilized by the currently preferred embodiment.) Simple intake ports, upper and lower transfer ports, and outlet ports are introduced into the cylinder walls.

In the currently preferred embodiment, combustion occurs in an alternating fashion at either cylinder end, between the top of each piston head and its respective cylinder head. For purposes of illustration, the sequence of events is described beginning with the piston/connecting rod assembly closest to the cylinder head on one side of the device: for instance, the left side. In this position, the charge in the left-side combustion chamber has been compressed to the point of auto-ignition. Once it ignites, the piston/connecting rod assembly begins its expansion stroke toward the right. On the right side, fresh intake air is drawn past the right-side intake port and reed valve into the chamber formed between the underside of the right-side piston and the central, axially fixed divider element. Meanwhile, in the right-side combustion chamber formed between the piston head and cylinder head once the piston head has closed the outlet port, the intake air from the previous stroke is compressed and fuel is injected. At the same time, the fresh intake air pulled into the left-side under-piston chamber on the previous stroke is compressed by the motion of the piston toward the central divider element. Once the left-side piston head has passed the left-side outlet port, the expanding combustion products from the left-side combustion chamber are evacuated through the outlet port toward the power turbine (or positive-displacement gas-driven motor, in an alternative embodiment). When evacuation is complete, the left-side piston uncovers the left-side upper transfer port, and pressurized fresh air from the left-side under-piston chamber is admitted through this transfer port into the left side combustion chamber, scavenging any remaining combustion products. The piston/connecting rod assembly then reaches its farthest extent on the right side, the right-side charge auto-ignites, and the cycle begins again. The operation is similar to that of a standard twin-cylinder, twin-piston engine using a two-stroke cycle, except that there is no crank, no conventional crankcase, no conventional rods connecting the pistons to the crank, and no conventional spark-ignition system.

Advantages

Several advantages of the currently preferred embodiment over conventional gas turbine engines, conventional crank-piston engines, crank-piston HCCI engines, compound free piston-gas turbine engines of the prior art, and free-piston HCCI engines configured as electrical linear alternators or hydraulic or pneumatic pumps have already been enumerated in the previous section. Further advantages over these and additional engine types are detailed below.

In comparison to a conventional gas turbine engine: 1) The present invention is able to reduce manufacturing costs, since an easily machined free-piston combustor (gas generator) and conventional supercharger or turbocharger replace multiple, high-precision compressor and compressor turbine stages. 2) The present invention can be idled at much lower fuel consumption, since the variable stroke of the free-piston combustor (gas generator) enables it to attain maximum compression at idle. 3) The present invention's use of a piston-based combustor (gas generator) eliminates the possibility of compressor stall in the event of a sudden application of full load to a previously unloaded engine. 4) The present invention operates with relatively low temperatures at the inlet nozzles of the precompressor turbine and power turbine (or gas-driven motor), since peak combustion temperatures are attained at the top of the piston stroke and are greatly reduced by the time the working fluid is expanded at the end of the piston stroke and directed toward the precompressor turbine and power turbine/gas-driven motor. This feature enables noncritical materials to be used in the manufacture of precompressor turbine and power turbine/gas-driven motor, further decreasing manufacturing costs (see Underwood, p. 379).

In comparison to two- and four-stroke compression-ignition direct-inject ("diesel") crank-piston engines and two- and four-stroke spark-ignition ("petrol") crank-piston engines: 1) Thermodynamic efficiency is improved though the utilization of the Pescara thermodynamic cycle, which eliminates the energy losses inherent in Otto and Diesel cycles and approximates a Miller or Atkinson cycle in terms of allowing the effective expansion stroke to be longer than the compression stroke. 2) The rapid burn rate and high piston speed of the present invention improve thermodynamic efficiency by reducing the time available for the heat of combustion to transfer to cylinder walls. 3) Engine efficiency is improved via the elimination of side loads, decreased reciprocating masses, and reduced incidences of sliding friction from conventional connecting rods, crank bearings, cams, and camshafts. 4) Both weight and cost are reduced via the elimination of crankshaft, conventional connecting rods, flywheel, valves, and camshaft. 5) The reduced duration of high combustion temperatures and the reduced peak temperatures of HCCI combustion at low loads and equivalence ratios results in the drastic reduction of $NO_x$ emissions. At the same time, particulate emissions are reduced as a result of the high fuel atomization and complete burning inherent in HCCI combustion. (See U.S. Pat. No. 6,199,519, FIGS. 8; 11-16; also Energy Efficiency and Renewable Energy, Office of Transportation Technologies, "Homogeneous Charge Compression Ignition [HCCI] Technology: A Report to the U.S. Congress, April 2001" [U.S. Department of Energy, Washington, D.C., 2001], pp. 1-5.) 6) The very high compression ratios attainable in the present invention facilitate uniformly high temperatures of the compressed charge and thus enable the utilization of a wide range of fuel types, including high-viscosity/low-volatility fuels such as Bunker C, Jet-A, kerosene, diesel oil, vegetable oil, and certain types of unrefined crude oil (See Underwood, p. 378). It is anticipated that the present invention should also operate satisfactorily on gaseous fuels such as butane, CNG, LPG, and pure and impure hydrogen, as well as renewable fuels such as biodiesel, pure ethanol, and pure methanol, without engine modification (see U.S. Pat. No. 6,199,519). Finally, it is anticipated that gasoline and other hydrocarbon fuels of poor quality and/or very low octane and cetane ratings may be utilized, as knock inhibition is not required.

Relative to spark-ignited crank-piston engines specifically: 1) Thermodynamic efficiency is improved though the facilitation of higher compression ratios, since knock, or detonation, is not a limiting factor to compression. In fact, detonation is utilized by the present invention and all HCCI engines as the normal operating mode. 2) The present invention is capable of running at equivalence ratios well below what is possible in conventional spark-ignited engines. This ability to run at lean mixtures leads to better thermodynamic efficiency and allows the engine to be run unthrottled, greatly reducing pumping losses. 3) Since lean mixtures require higher initial temperatures to auto-ignite than do richer mixtures, still higher compression ratios are facilitated during lean running. 4) Finally, variable stroke ensures a consistently high effective compression ratio over all load and speed requirements: the engine increases and decreases its working displacement automatically as load and speed dictate. This is a crucial advantage where a wide range of loads and speeds is anticipated, as in an automobile or other mobile application.

Relative to two-stroke spark-ignited crank-piston ("petrol") engines specifically: 1) The currently preferred embodiment of the present invention utilizes non-critically-timed low-pressure fuel injection into the cylinder after the outlet port closes, preventing loss of fuel through the outlet port. 2) The currently preferred embodiment utilizes a closed-circuit lubrication system in which lubricant is introduced through the hollow connecting rod and does not directly enter the under-piston chamber or mix with the fuel. This reduces undesirable emissions by reducing the amount of lubricant that is burned during combustion. (For the currently preferred embodiment, standard multiweight motor oil is contemplated as a lubricant. Additional lubricant options may include vegetable oils and solid or semi-solid lubricants, as well as unconventional lubricants such as water or gaseous elements.)

Finally, relative to four-stroke rotary (Wankel) engines, the present invention offers improved compression ratios, particularly at low loads. It has reduced incidences of sliding friction, as well as improved sealing, a faster burn rate, and an ability to run at low equivalence ratios, which the spark-ignited Wankel engine cannot accommodate.

DETAILED DESCRIPTION OF THE INVENTION

Figure 1:
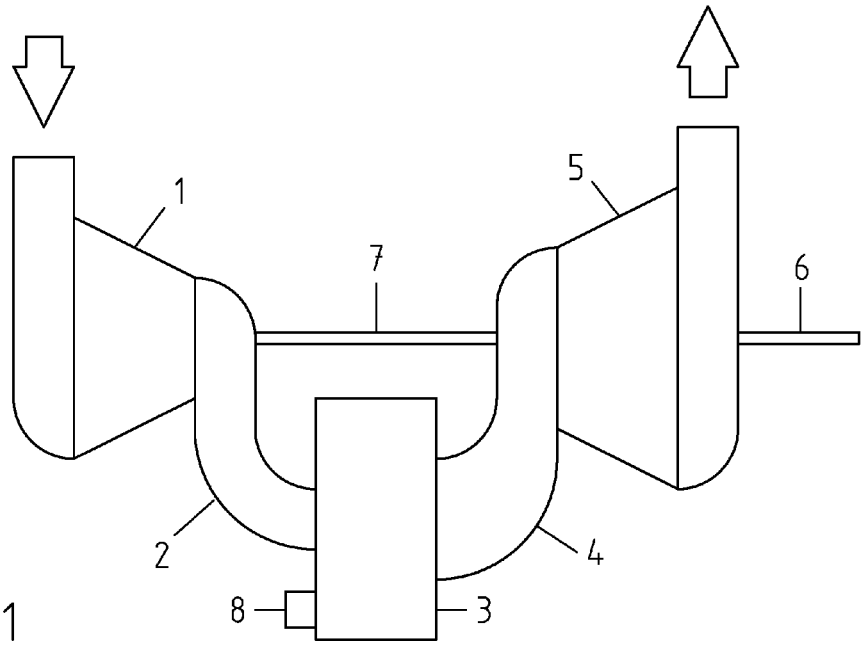
FIG. 1 is a schematic diagram of the overall compound engine of the currently preferred embodiment showing an optional, rotary precompressor driven by a shaft from the power turbine/gas-driven motor. In this embodiment, the precompressor functions much like a conventional belt- or gear-driven supercharger, and may utilize positive-displacement or centrifugal compressor means depending on engine application.

FIG. 1 shows one possible arrangement that might be compared to a supercharged piston engine where the crank and connecting-rod assembly has been replaced by an aerodynamic power turbine or positive-displacement gas-driven motor. Intake air (represented by the downward-pointing arrow) may be compressed in precompressor element 1, which may be an aerodynamic or positive-displacement unit, depending on the application. Precompressor 1, if used, is a high-volume, low-pressure device compared to the oscillating piston in the combustor (gas generator) of the engine, which may have a compression ratio of much greater than 20:1, depending on operating conditions. Intake duct work 2 conducts the pre-compressed air to the intake ports of the free-piston combustor (gas generator) 3. The high-temperature, high-pressure gas from combustor (gas generator) 3 is conducted by duct work 4 to rotary device 5, which may be an axial or centrifugal turbine, an impulse turbine, or a positive-displacement gas-driven motor that may use vane or lobe-type technology. The useful work from the compound engine appears on rotating shaft 6, which substitutes for the crankshaft in a conventional piston engine. Exhaust gas from the overall engine is represented by the upward-pointing arrow. Auxiliary shaft 7 drives optional precompressor 1 in a fashion similar to a conventional belt- or gear-driven supercharger. Blow-off valve 8 releases pressure in the combustor (gas generator) in case of an overpressure condition on the intake side of the combustor (gas generator) that could damage precompressor 1 or otherwise compromise safety.

Figure 2:
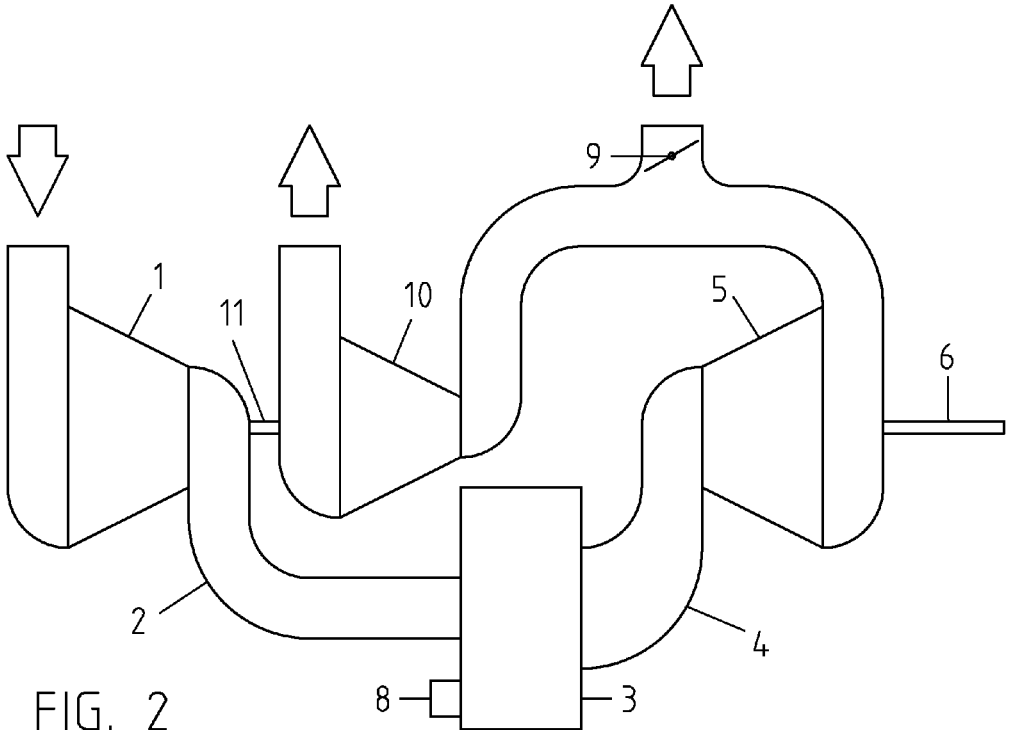
FIG. 2 shows an alternative embodiment in which an independent precompressor turbine or gas-driven motor is driven by the expanding gases from the free-piston combustor (gas generator) after they have passed through the power turbine/gas-driven motor. In this embodiment, the precompressor functions much like a conventional turbocharger.

FIG. 2 shows another possible arrangement that is similar in function to the arrangement of FIG. 1, but that might be conceived of as a conventional gas turbine engine (turboshaft) that has a free-piston combustor (gas generator) element for higher thermodynamic efficiency. As before, intake air may be compressed in precompressor 1 and fed through duct work 2 to the crankless, free-piston combustor (gas generator) 3. The high-temperature, high-pressure output gas from combustor (gas generator) 3 is conducted by duct work 4 to the power turbine/gas-driven motor 5. The power output is on shaft 6. After passing through power turbine/gas-driven motor 5, the output gas may be conducted through ductwork to auxiliary gas-driven motor 10, and the energy remaining in the gas may be utilized to drive precompressor 1 through short shaft 11, much as a conventional turbocharger is driven by engine exhaust. Waste gate 9 allows excess gas to be bled off to the atmosphere to prevent excessive rotational speed of auxiliary gas-driven motor 10 and precompressor 1. As in the arrangement in FIG. 1, blow-off valve 8 provides safety from an overpressure condition.

Figure 3:
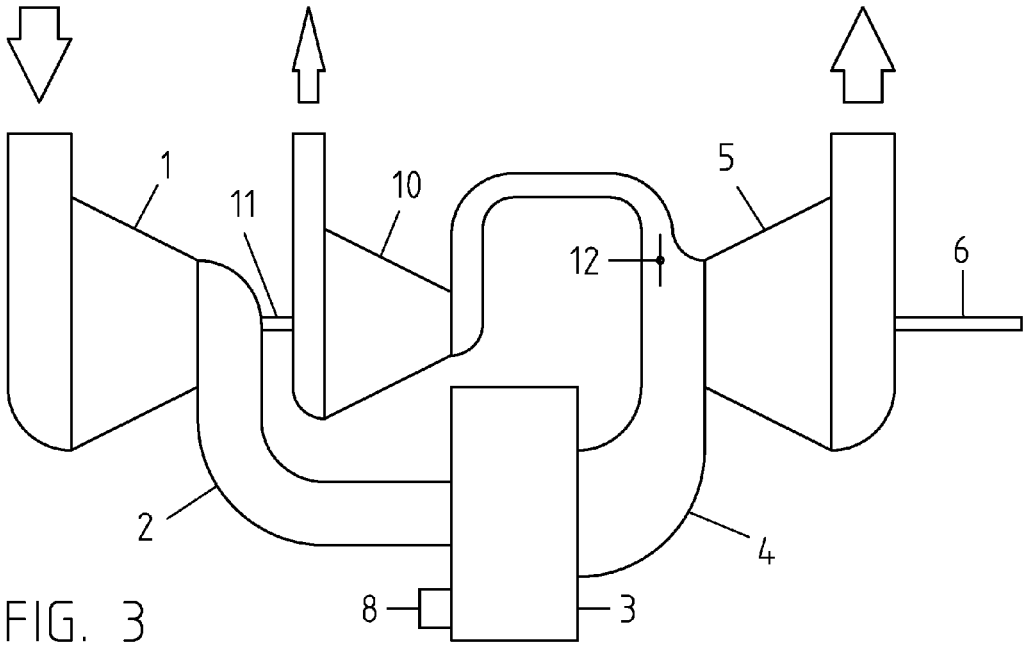
FIG. 3 shows an alternative embodiment similar to FIG. 2, but in this instance the optional precompressor turbine or gas-driven motor (turbocharger) is driven from a portion of the pressurized gas from the free-piston combustor (gas generator) that is diverted from the main flow before it reaches the power turbine/gas-driven motor.

FIG. 3 presents an alternative embodiment similar to FIG. 2, but in this case a smaller volume of higher-energy gas from a branch of outlet duct 4 is drawn off prior to entering power turbine/gas-driven motor 5, and used to drive auxiliary gas-driven motor 10 and thereby precompressor 1, via short shaft 11. Diverter valve 12 regulates the amount of energetic gas delivered to auxiliary gas-driven motor 10 in much the same way as a conventional waste gate on a turbocharger, but without wasting any of the output from combustor (gas generator) 3. This arrangement, as shown in FIG. 3, represents the currently preferred embodiment of the overall compound engine.

Figure 4:
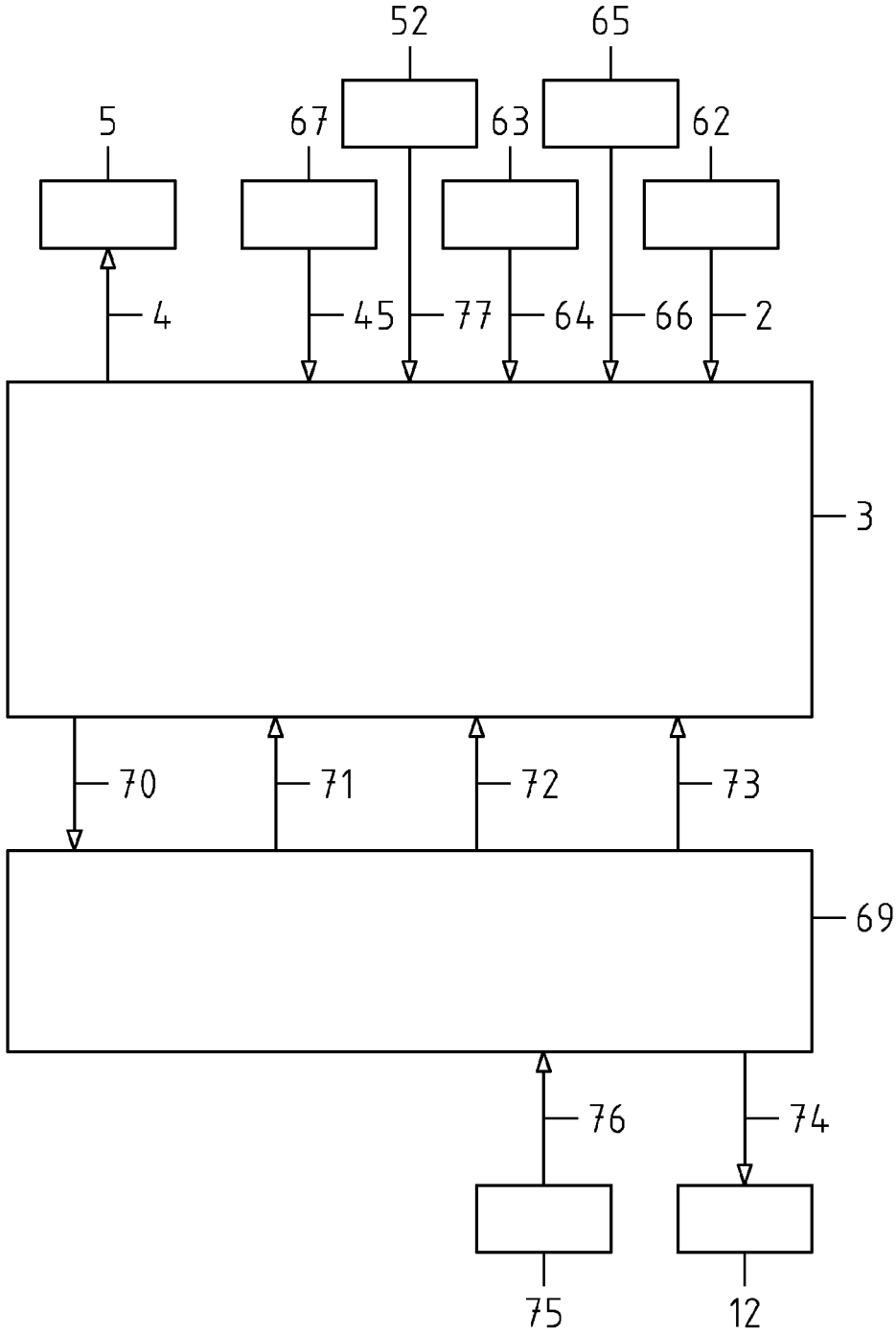
FIG. 4 is a schematic view of the free-piston combustor (gas generator) portion of the compound engine (component 3 in the earlier figures), indicating air inlets, fuel inlets, and fuel source, as well as optional elements including starting inputs, electrical sensor means, engine control unit, and lubrication system components.

FIG. 4 begins the focus on free-piston combustor (gas generator) 3, which contains many of the innovative elements of the present invention in comparison with previous art. This schematic diagram shows a currently preferred embodiment and structural connectivity of components, each of which will be described in greater detail in later figures. In this diagram, combustor (gas generator) 3 receives combustion air from a source 62, which may be precompressor element 1 (see FIGS. 1, 2, and 3) or ambient air, through connecting duct 2. The combustor (gas generator) also receives fuel from a source 63 through fuel-supply line(s) 64. An optional electrical power source 65 may direct current through line(s) 66 to initiate oscillating piston motion in the combustor (gas generator) for easier starting or for controlling the phase of multiple piston assemblies in the event that multiple combustors (gas generators) are used. In another embodiment, starting power may be provided by compressed air, traveling from reservoir 52 through compressed air supply line(s) 77. Components in combustor (gas generator) 3 may be lubricated from a lubrication source 67 through lubrication-supply line 45. (Alternatively, lubrication may be added to the combustible charge, or the moving surfaces may be made of a self-lubricating material.) The output of combustor (gas generator) 3 is energetic, hot gas that is conducted through ducting 4 to turbine or gas-driven motor 5 (see FIGS. 1, 2, and 3.) An electronic control unit (ECU) 69, while not required to produce an operating engine, is shown because of the additional capability it may provide. If the ECU is used, sensor(s) of piston position in combustor (gas generator) 3 provide an electrical signal through signal line(s) 70 to ECU 69. ECU 69 processes the position signal to produce optional control power to optional spark plug(s) in combustor (gas generator) 3 via spark control line(s) 71. ECU 69 also produces optional control power to optional fuel injector(s) via control line(s) 72, as well as optional control power means for adjusting the phase of piston motion, if multiple combustors (gas generators) 3 are used, via control line(s) 73. ECU 69 may also provide optional control power to precompressor control 12 (see FIG. 3) via control line 74. ECU 69 is powered from an optional power supply 75 through optional power supply circuit lines 76.

Figure 5:
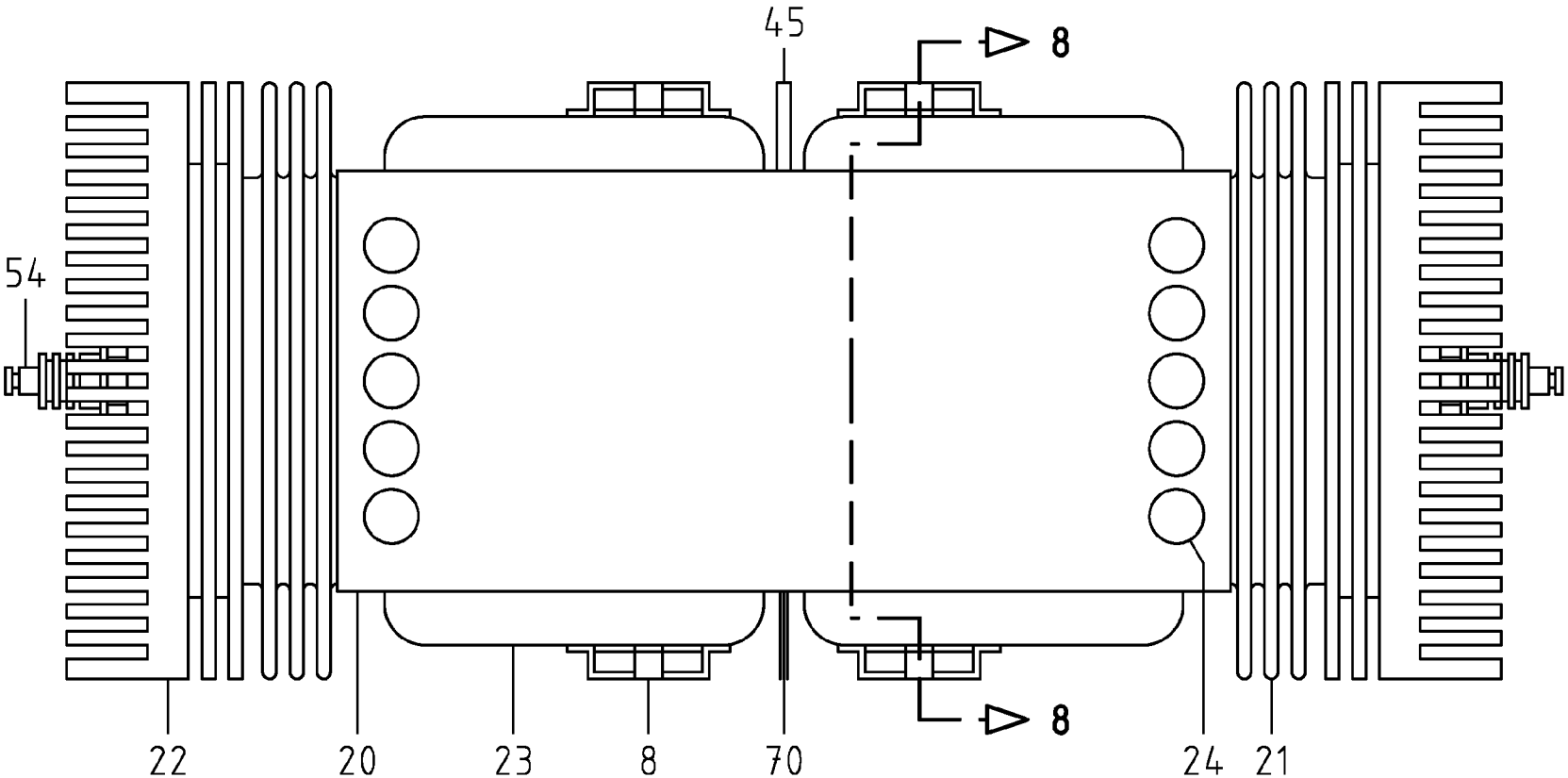
FIG. 5 is a view from the gas output side of the combustor (gas generator).

FIG. 5. shows an external view of combustor (gas generator) 3 looking toward the gas outlet side of the combustor (gas generator). (This and following figures show a currently preferred embodiment, including air cooling for example, but many variations are possible.) Note the mirror symmetry in this embodiment, which allows one reference number to refer to a number of elements. In this view, the free-piston combustor (gas generator) of the engine exhibits mirror symmetry about a horizontal plane through the axis and about a plane perpendicular to the axis.

In FIG. 5, main casing 20 serves as the foundation for the free-piston combustor (gas generator). It may have a square cross section for ease of manufacture and attachment of duct work and auxiliary parts. Cylinders 21 are inserted in the casing to provide a precision bore for the free-piston assembly. Cylinder heads 22 on both ends of the combustor (gas generator) form the combustion chambers. Heads are very simple and require no valves, ports, or other complications. Transfer passages 23 are part of the charging and scavenging system for combustion and will be shown in other ways in following views. Blow-off valves 8 are mounted on the transfer passages 23 and are shown in more detail later. Outlet ports 24 are opened and closed by the piston assembly, as will become clearer in following views. The outlet ports are comprised of a plurality of holes and interspaced webbing in order to avoid catching piston rings. Spark plugs 54 may be provided for initial starting. Optional piston-location signal line 70 and optional lubrication supply line 45 are indicated, and will be described later in greater detail. Broken line 8-8 shows the plane of a sectional view which will be shown in FIG. 8. The section plane is staggered axially to show details of the transfer passages 23, the blow-off valves 8, and the lower transfer ports.

Figure 6:
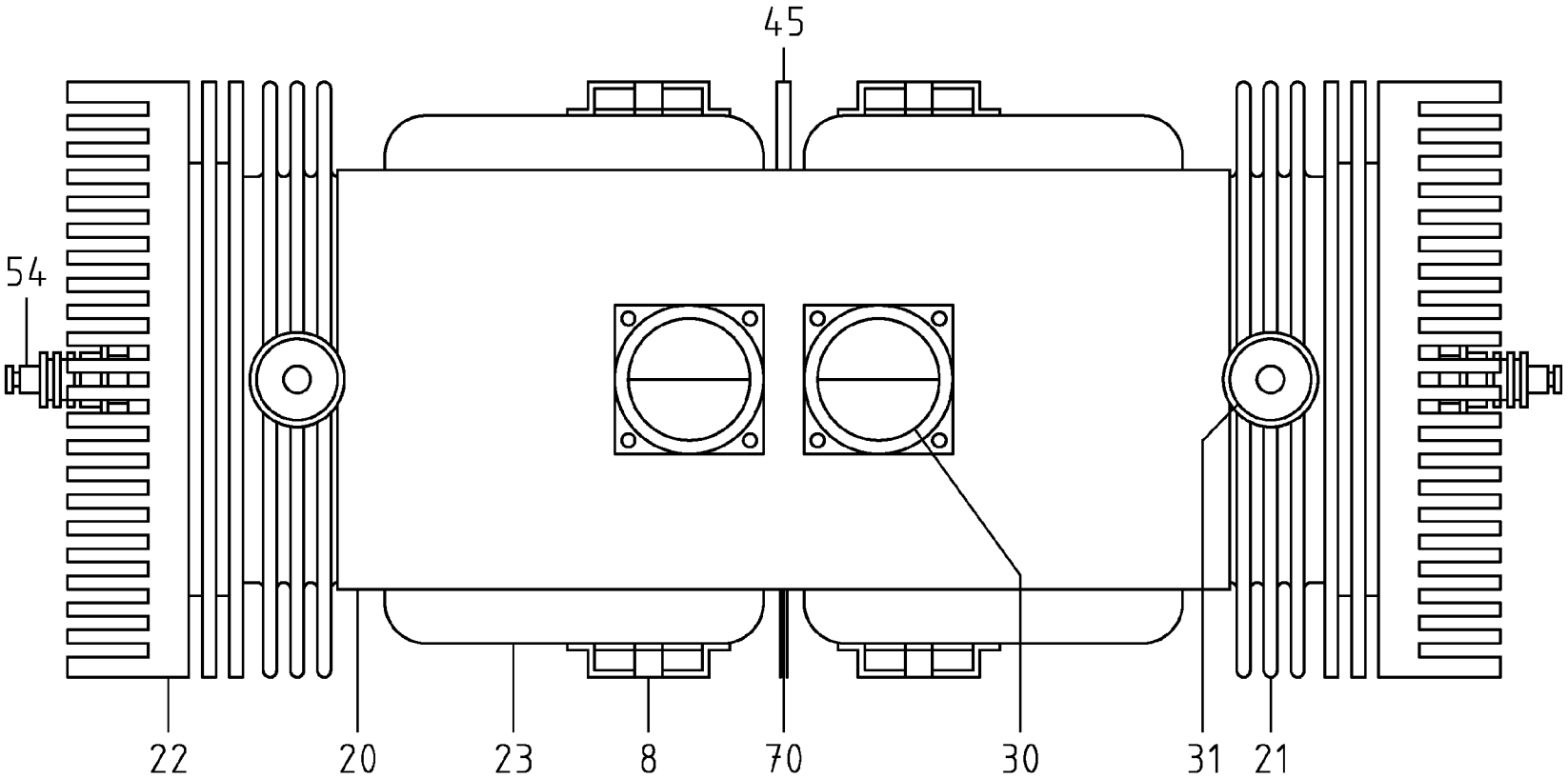
FIG. 6 is similar to FIG. 5, except the view is of the intake side of the combustor (gas generator).

FIG. 6 is similar to FIG. 5 except that the view is toward the intake side of the combustor (gas generator), a 180-degree rotation of the combustor (gas generator) from the previous view. As before, casing 20 supports cylinders 21, which are capped by heads 22. Transfer passages 23 are again in position on casing 20 and include blow-off valves 8 as part of each assembly. Optional piston-location signal line 70 and optional lubrication supply line 45 are indicated, as are optional spark plugs 54. Intake ports and reed valve assemblies 30, which will appear in other views, feed the intake air into the casing below the pistons (i.e., toward the center of the casing). Optional fuel injectors 31 are mounted on flats machined into the side of the cylinders 21. (Although in-cylinder injectors are used in the currently preferred embodiment to reduce fuel lost through the outlet ports, alternative embodiments may utilize carburetors or throttle-body injectors upstream of the intake ports, and may utilize intake ports controlled by the piston skirts or by self-actuating poppet valves rather than by reed valves, for example. Placement of the in-cylinder injectors in the cylinder heads rather than the side of the cylinders is also possible.)

Figure 7:
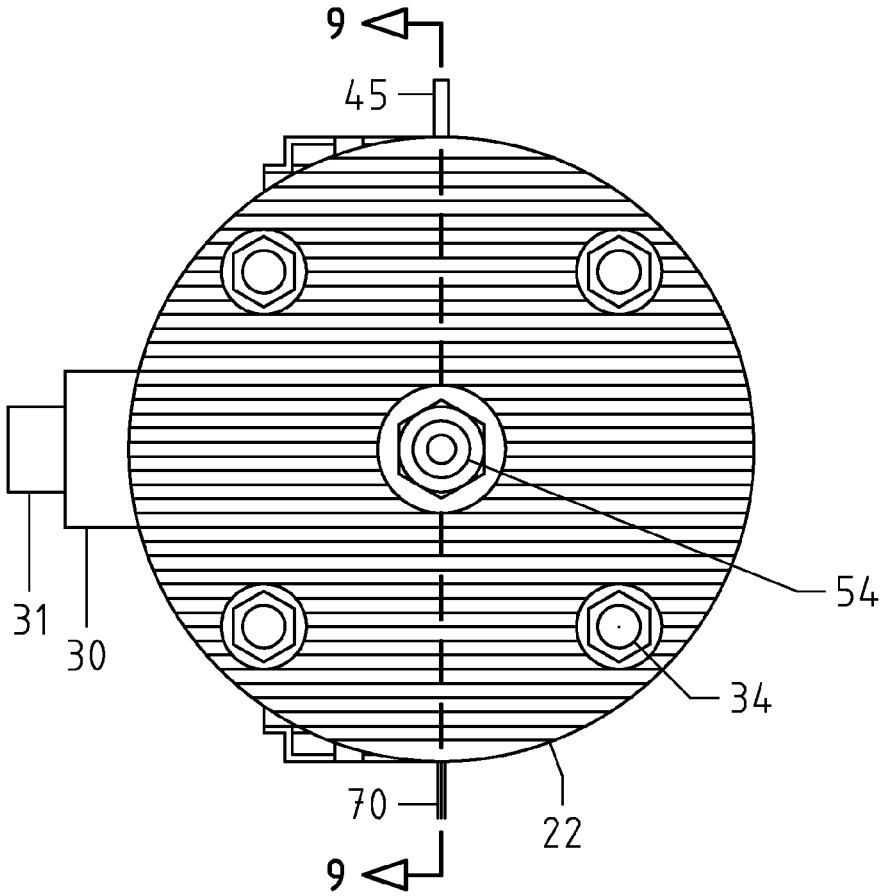
FIG. 7 is an end view of the free-piston combustor (gas generator) showing the section cut for the major internal view.

FIG. 7 is a view looking along the axis of the cylinder at one end of the combustor (gas generator). The view is dominated by the cylinder head 22. Intake port and valve housings 30 project beyond head 22 on the intake side of the combustor (gas generator), as do optional fuel injectors 31. Head-attachment studs 34 are anchored in the corners of the casing and hold the combustor (gas generator) together. An optional spark plug 54 is shown in the center of head 22. Optional piston-location signal line 70 and optional lubrication supply line 45 are indicated. Broken line 9-9 shows the plane of a sectional view which will be shown in FIG. 9.

Figure 8:
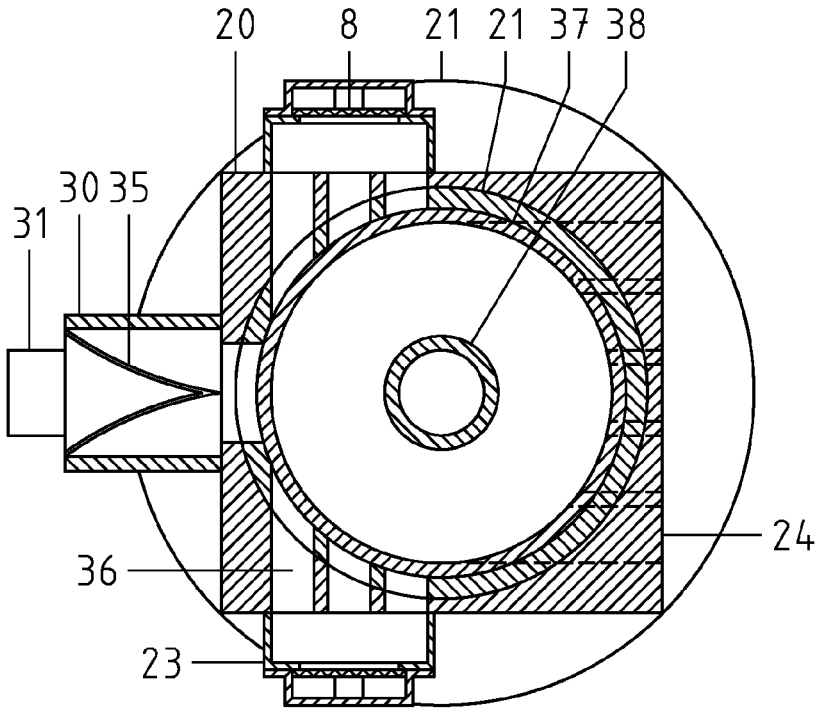
FIG. 8 is a transverse section of the combustor (gas generator) showing the intake valve, blow-off valve, and lower transfer ports.

FIG. 8 is the sectional view along the axis of the combustor (gas generator) taken looking near the center of the combustor (gas generator) toward the cylinder head, as indicated in the section lines on FIG. 5. The square cross section of the foundational casing 20 is clearly seen in this view. Cylinder 21 is seen in section as a sleeve insert in the casing and is seen looking at the underside of the lowest cooling fin, which is also referenced as 21 in this view. The transfer passages 23 are shown in section on the upper and lower faces of the casing 20. Blow-off valves 8 are shown in section attached to the transfer passages 23. The blow-off valves are light, gasketed disks, shown cross-hatched, covering large holes in the transfer-passage housing 23. A four-leg frame above the valve disks centers the disks on the hole and captures a coil spring (not shown) sealing the disks against the transfer passages. In the event that excess pressure develops below the piston, gases will pass through the lower transfer ports (see next paragraph) into the transfer passages 23 and out blow-off valves 8.

In FIG. 8, intake port and valve housing 30 is seen in section; note the port as a drilled passage (no hatching) through the side of both casing 20 and cylinder 21. Optional fuel injector 31 is again largely hidden behind the intake housing 30. Optional intake reed valves 35 are schematically indicated in the intake-port housing. There are six lower transfer ports 36 cut by the section plane in this half of the combustor (gas generator). They are drilled perpendicular to the upper and lower faces of casing 20. As in the case of the outlet ports, a plurality of drilled holes comprising the port allow for webs between holes to avoid catching piston rings. The section plane cuts also the piston 37 at the skirt level and the connecting rod 38, which is tubular in this embodiment. The region between the piston 37 and the connecting rod 38 is the underside of the mounting plate that connects the rod to the piston, identified as mounting plate 39 in the next view. Outlet ports 24 are seen in this view as hidden lines, which show the plurality of outlet ports and their angular relationship to both intake and lower transfer ports. Optional piston-location signal line 70 and optional lubrication supply line 45 are not visible in this view.

Figure 9:
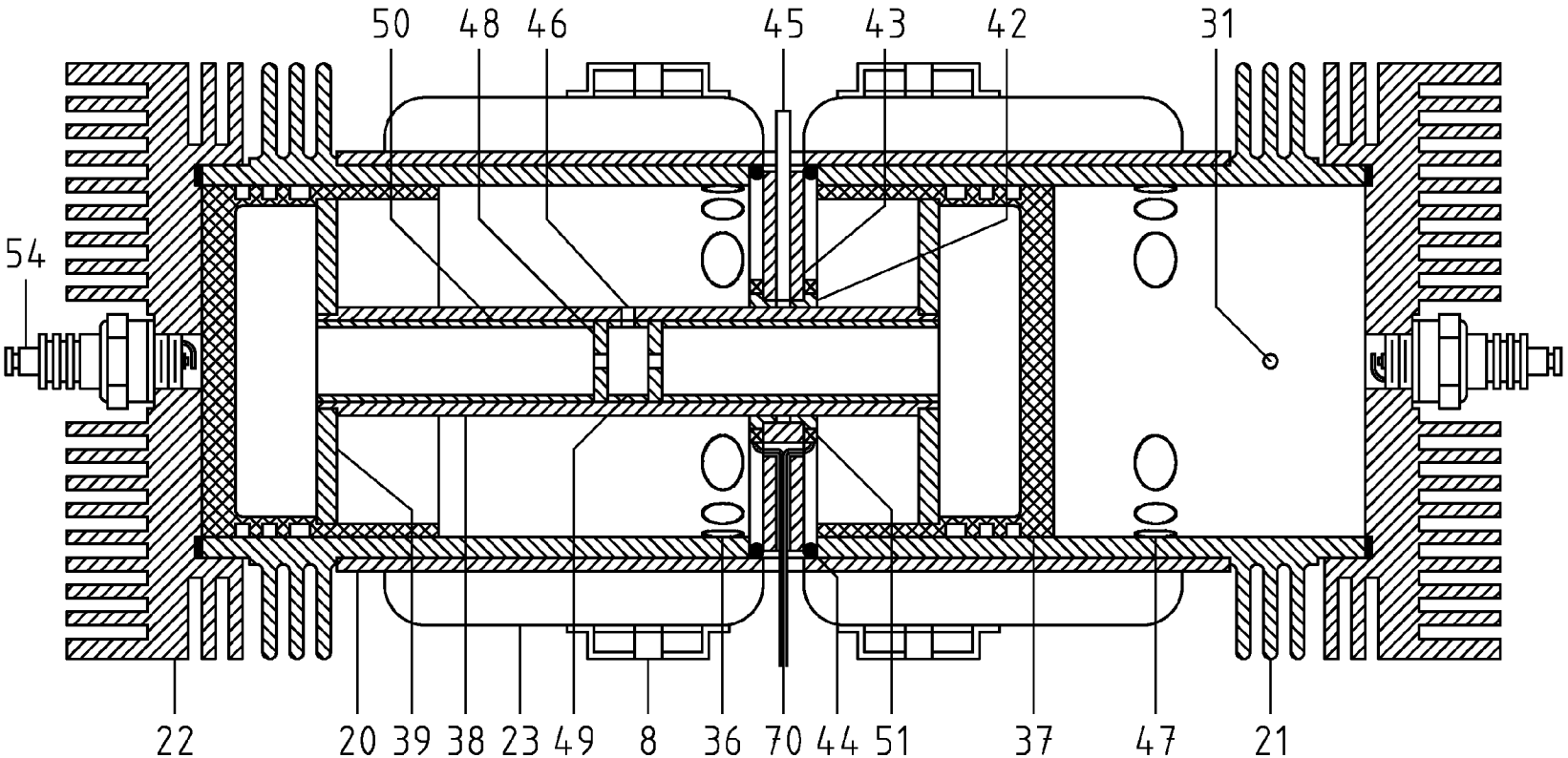
FIG. 9 is a longitudinal section of the combustor (gas generator) revealing the internal geometry and major aspects of the currently preferred embodiment, including the piston-connecting rod assembly, divider element, and transfer passages.

FIG. 9 reveals the inner structure that is at the heart of the free-piston combustor (gas generator) in the currently preferred embodiment. Casing 20 again serves as the foundation to connect and align the cylinders 21. Cylinder heads 22 are seen to overlap the upper ends of the cylinders 21 and constrain the conventional head gaskets shaded solid between the cylinder 21 and head 22. Transfer passages 23 are just behind the sectioning plane and are not cut by it. Intake ports are hidden behind the connecting rod in this view. Optional fuel injector 31 is behind, and represented by, the small port in the cylinder beneath the nozzle of the injector. The rest of the injector 31 is hidden. Lower transfer ports 36 are seen as drilled holes cutting the walls of cylinder 21 in the back (intake) side of the combustor (gas generator).

In FIG. 9, pistons 37 are attached to the tubular connecting rod 38 by mounting plates 39. Together, these parts comprise the rigid piston assembly 37-38-39. The pistons 37 are by themselves similar to conventional practice in automotive and aircraft piston engines and can be fabricated by modifying standard parts. The piston assembly 37-38-39 is shown at the extreme of the stroke to the left with zero clearance from the cylinder head 22. This is to check that there is no mechanical interference at any position in the variable stroke that is allowed by the free-piston geometry. In practice, the stroke while running will never be as large as that shown here.

Divider element 43 shown in FIG. 9 is a key part of the currently preferred embodiment. It divides the volume beneath the pistons into two independent chambers, and provides a mount for bushings 42 through which tubular connecting rod 38 slides. Divider element 43 is sealed by two elastomer O-rings 44 (solidly shaded, sectioned circles), which, in conjunction with the radial clearance between the divider element 43 and casing 20, allow the divider element to float radially while being axially fixed. This freedom prevents any binding between the bushings 42 and connecting rod 38 and simplifies both manufacture and assembly of the free-piston combustor (gas generator). A hole drilled through casing 20 and radially though divider element 43 allows the passage of lubrication-supply line 45, which delivers lubricant to the space between the inner ends of the bushings 42. When hole 46 in tubular connecting rod 38 passes the lubricant-filled space between bushings 42, lubricant is metered into the tubular connecting rod 38. This lubricant migrates to the space under the head of pistons 37 and lubricates the piston rings from the inside of the piston 37 through oil slots (not shown) in the piston beneath the piston rings (not shown) as is standard procedure in air-cooled piston engines. Any excess lubricant gathers at the lowest point in the center of casing 20 and may be removed and reused in a dry-sump configuration.

The upper transfer ports 47 in FIG. 9 are drilled through casing 20 and cylinder 21. The passages in the ports 47 are oriented perpendicularly to the axis of the outlet ports so that the flow from the two sets of ports converges in the cylinder on the side away from the outlet ports. This convergence directs the incoming intake air upward toward the cylinder head 22 rather than out the outlet ports. In the preferred embodiment, outlet port 24, which is shown in FIG. 5 but not visible in this section, opens slightly before upper transfer port 47, although this timing is subject to further research.

FIG. 9 also details optional electronic piston-location sensing means that are referenced above. These means consist of two permanent ring magnets 48 which are inserted into connecting rod 38 and which are symmetrically arranged about the center of the piston assembly 37-38-39. The ring magnets have holes in the center to pass the lubricant fed through port 46. They are separated by a light sleeve 49 which incorporates a hole aligned with port 46. The sleeve 49 and magnets 48 are held in place with light sleeves 50. Pickup coils 51 are symmetrically arranged on either side of divider element 43. The changing magnetic field generated by the motion of magnets 48 induces a current pulse in coils 51 for each stroke. This induced pulse is conducted through piston-location signal line 70 to an electronic control unit (ECU) (not shown—refer to FIG. 4, item 69). The ECU determines both frequency and phase of the harmonic motion and synthesizes a phase-locked digital oscillator matched to the (changing) harmonic motion of the piston assembly. From this digital oscillator, the ECU may calculate the precise time for fuel injection, and may provide other dynamic operating parameters and control signals to various vehicle systems and instruments, as indicated in the detailed description of FIG. 4, above).

Figure 10:
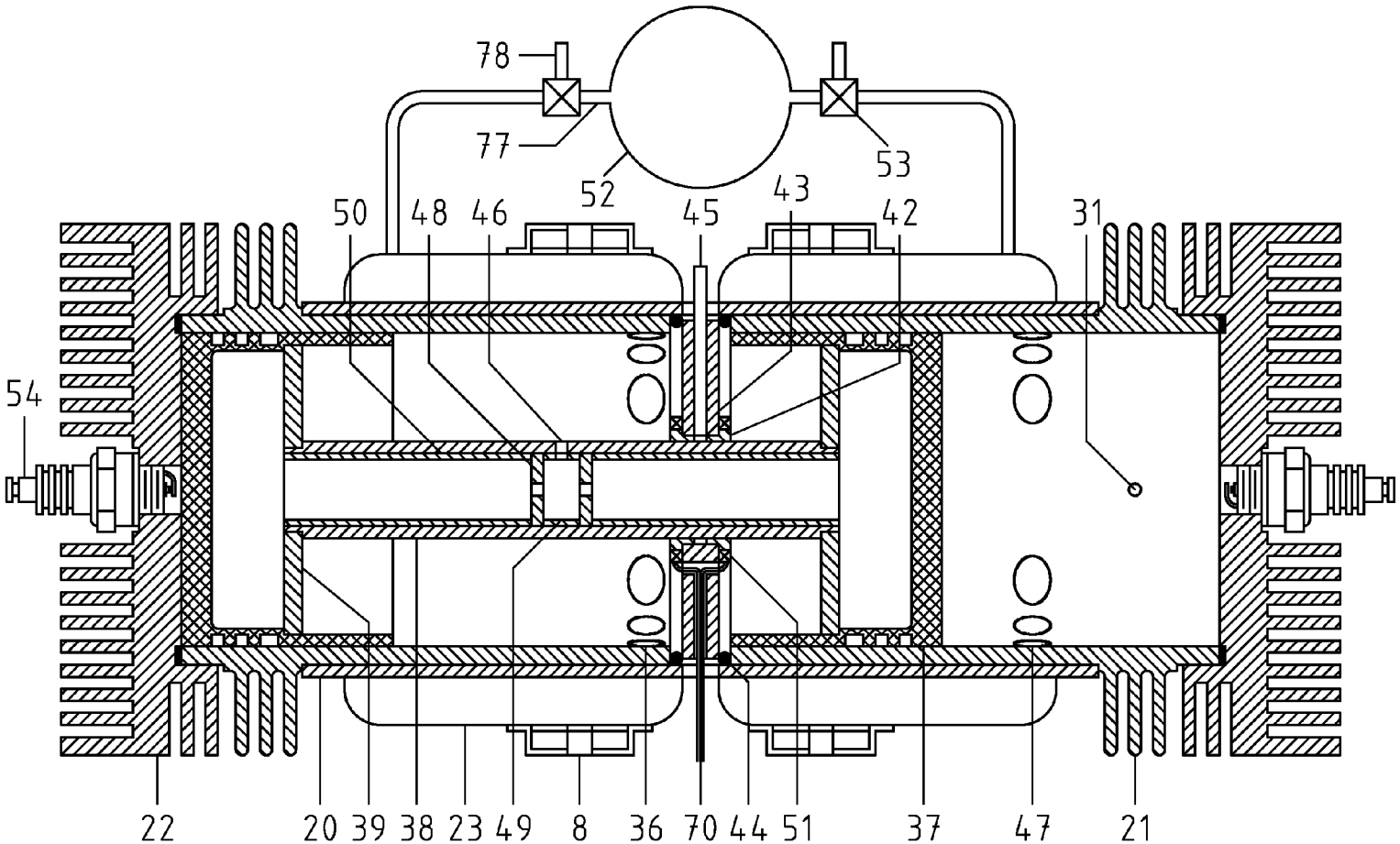
FIG. 10 shows the same longitudinal section of the combustor (gas generator) shown in FIG. 9, but adds an optional compressed-air mechanism to impart oscillation to the piston assembly for improved starting.

FIG. 10 contains all the elements referenced in FIG. 9 and goes beyond that figure to indicate the elements of optional compressed-air starting means for the engine. (Note that the means described below will impart an oscillating motion to the piston assembly and build compression in alternate combustion chambers to facilitate starting, but these means are not required.) The compressed-air starting process is as follows: 1) At rest, the piston assembly 37-38-39 will be assumed to be centered, as this is the position where the pressure in all chambers and transfer passages is equalized at ambient levels. In this position, upper transfer ports 47 in both combustion chambers will be covered by pistons 37. 2) Compressed air from reservoir 52 is introduced through one of supply lines 77 to one of the three-way valves 53 (for instance, the right valve) into the chamber formed between the underside of the piston 37 and the divider element 43 (for this discussion, the right-hand under-piston chamber). This drives the piston assembly 37-38-39 toward right-hand cylinder head 22 (implied by symmetry). 3) Once the head of right piston 37 has closed off right-side outlet port 24 (not shown), fuel is injected into the right-side combustion chamber through fuel injector 31. 4) When pressure in the right-side combustion chamber equals that fed into the right-side under-piston chamber from compressed-air reservoir 52, the piston has reached the furthest extent of its travel toward the right cylinder head 22 (analogous to "top dead center"), and a spark is introduced through spark plug 54, driven by a standard electronic ignition system which may be controlled by the electronic sensing means and electronic control unit described earlier. 5) Assuming conditions are conducive to combustion, the charge ignites, and the piston assembly 37-38-39 is driven to the left. At the same instant, the right-side three-way valve 53 is opened such that pressure in the right under-piston chamber is vented to the atmosphere through right-hand vent line 78. This facilitates the motion of piston assembly 37-38-

39 and prevents an overpressure situation in the right-side under-piston chamber. 6) The piston assembly 37-38-39 moves to its furthest extent on the left, and the left-side combustion chamber fires, via either spark or auto-ignition. 7) Once the left-side combustion chamber fires, both three-way valves are closed, the spark-ignition system is deactivated, and the engine commences normal HCCI operation.

Note that the compressed-air starting system of FIG. 10 does not rely on the engine to fire on the first stroke. Instead, by means of filling one under-piston chamber, then evacuating that chamber at top dead center and simultaneously filling the opposite under-piston chamber, the engine may be "cranked" back and forth until ignition is achieved. Note as well that while a conventional electronic ignition system is provided for, it is possible that the compressed-air starting system as described above will achieve compression sufficient for HCCI operation without the need for an initiating spark. This desired behavior can be forwarded by rapidly opening and closing the three-way valves 53 to oscillate the piston assembly 37-38-39 at a high frequency. At the requisite oscillation speed, the resonance frequency of the spring-mass system composed of the compressed air in the opposed combustion chambers and the piston assembly 37-38-39 will be attained: this will maximize the amplitude of mechanical oscillation of the piston assembly and increase the compressing force of the pistons. Finally, note that the optional fuel injection system may be eschewed, and alternative means may be employed to deliver fuel to the combustion chambers. Regardless of which methods are chosen, magnets 48 and pickup coils 51 may be used to generate signals delivered through piston-location signal line 70 to the electronic control unit (see FIG. 4, item 69), which the ECU may use to control the timing of fuel injection and spark, where required, as outlined in the detailed discussion of FIG. 4.

Figure 11:
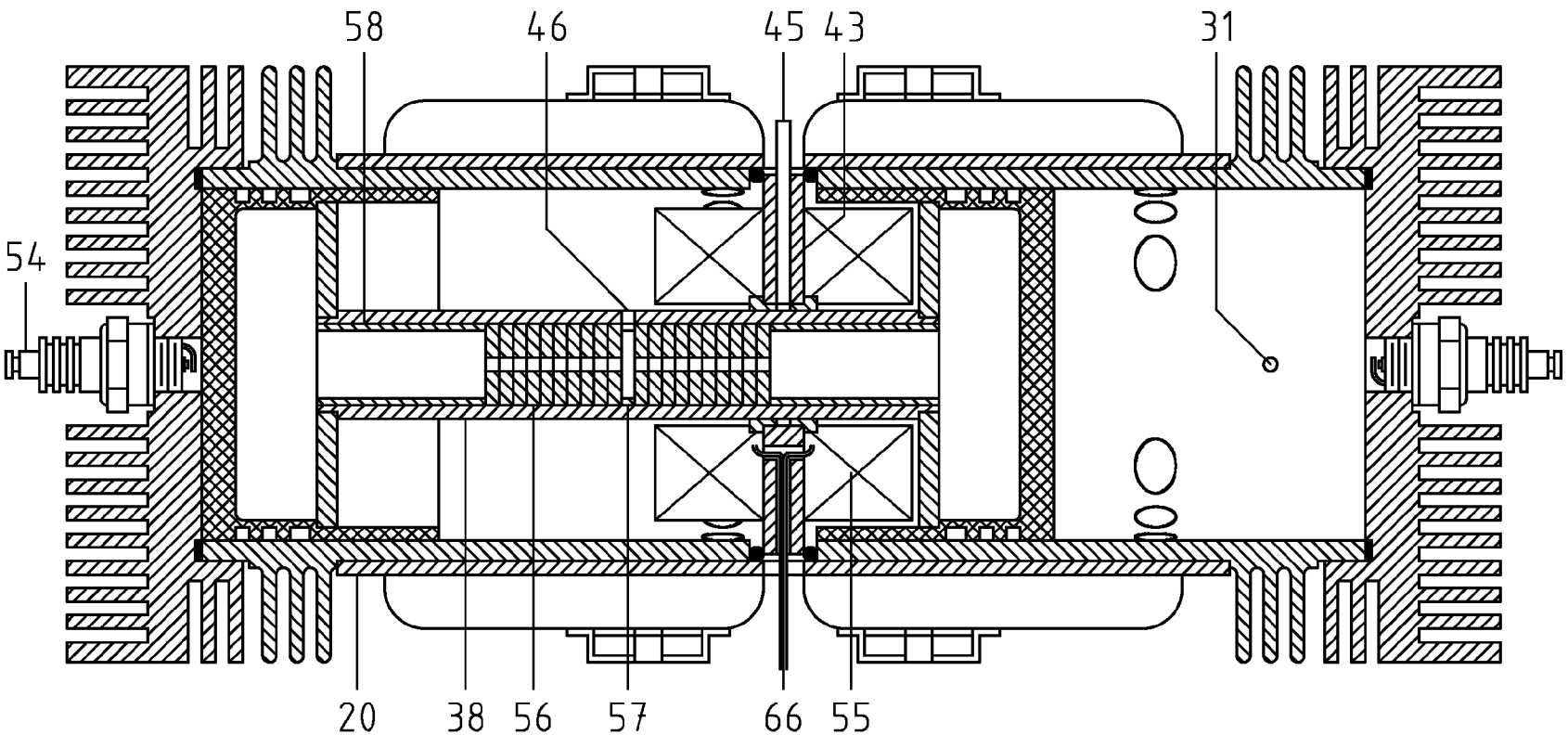
FIG. 11 presents a simplified view of the longitudinal section of the combustor (gas generator) shown in FIG. 10, but presents an alternative embodiment that incorporates an optional, integral linear electric motor/generator to impart oscillation for starting and, in the event that multiple free-piston combustors (gas generators) are used, to obtain favorably-phased oscillation rates of the piston assemblies of such combustors (gas generators).

FIG. 11 presents a simplified view of most of the elements referenced in FIG. 9 but adds an alternative to the compressed air starting system of FIG. 10. In this alternative embodiment, an integral linear electric motor is used for starting the free-piston combustor (gas generator) and for achieving favorable phasing between multiple oscillating piston assemblies in multiple combustors (gas generators), in the case that more than one combustor (gas generator) is employed in the compound engine. Fixed electromagnet coils 55 are attached to the divider element 43. Electrical power lines 66 for coils 55 pass through divider element 43 and casing 20 to a controlled electrical power source (see FIG. 4, item 65). The linear motor uses a series of permanent ring magnets 56 centered in the tubular connecting rod 38 and separated by a light sleeve 57. The ring magnets 56 are held in place by sleeves 58. The coils 55 produce a linear magnetic field in the space outlined by their cores that is much like the field produced by a bar magnet having N and S poles, but that can be controlled to switch the orientation of the field (location of the poles). By choosing proper polarity for the electromagnetic field, the permanent magnet can be centered in the coils. Then by switching polarity, the permanent magnet (and thereby the piston assembly) is driven away from the center, compressing the air/fuel charge to be combusted. The inventors have found in practice that momentum will carry the piston assembly through the stable center position to the unstable repulsion position, thus allowing the piston assembly to be oscillated back and forth. Choosing the proper frequency for the phase-locked oscillator driving the coils can take advantage of the resonance frequency of the spring-mass system composed of the compressed air in the cylinder and the piston assembly, thereby achieving a large-amplitude mechanical oscillation of the piston assembly for starting. Optional spark plugs 54 are again shown in FIG. 11, although it is anticipated that the above-detailed resonant oscillation may provide sufficient compression to initiate HCCI operation without the aid of a precipitating spark. Note that in this embodiment, piston-location signal line 70 is replaced by starter power line 66, which may be employed both to deliver power to coils 55 and to provide a passive piston-location signal that can be directed to an electronic control unit (see FIG. 4, item 69), when power is not being applied.

As stated above, the linear electric motor depicted in FIG. 11 can also be used to synchronize multiple free piston assemblies in the event that multiple combustors (gas generators) are used in the compound engine. To accomplish this, the coil/magnet configuration functions both as a linear motor and as a linear generator (alternator), depending on synchronization requirements. Functioning as a motor, the coil/magnet configuration accelerates the motion of the free piston assembly and increases oscillating frequency. Functioning as a linear generator (alternator), the coil/magnet configuration produces the opposite effect: piston motion is retarded, and oscillating frequency is reduced. The engine control unit (Not shown—see FIG. 4, item 69) is configured to control the current in multiple coil/magnet configurations in multiple combustors (gas generators) through electrical power line 66, whereby alternating current or an electrical load can be applied such that the motion of each piston assembly offsets that of the other(s). This minimizes vibration of the compound engine and evens out gas pulses so as to improve the efficiency and durability of the power turbine/gas-driven motor. Again, note that electrical power line 66 replaces piston-location signal line 70 in this embodiment, since electrical power line 66 may be employed to deliver power, to apply an electrical load, and to provide a passive piston-location signal when power is not being applied.

In conclusion, the combination of a two-stroke free-piston engine with a power turbine to provide rotating shaft output is not in itself new. What is new is the incorporation of the HCCI combustion model into this compound engine type. Additional novel elements include: 1) the division of the single cylinder casing into two functionally separate chambers by the use of an axially fixed, radially floating divider element; 2) the optional incorporation of non-critically-timed fuel injection into the cylinder after the outlet port closes; 3) the optional use of a closed-circuit lubrication system in the free-piston portion of the engine; 4) optional inclusion of an integral electrical linear motor for starting and possible phase control of multiple free-piston combustors (gas generators) coupled to a single output shaft; and 5) the use of a positive-displacement gas-driven motor as one way of utilizing the high-pressure gas output of the free-piston combustor (gas generator). Note that the use of a precompressor, as well as the substitution of a positive-displacement gas-driven motor for an axial or centrifugal power turbine, are all optional in the present invention. A precompressor increases the power density of the engine, but is not required. Similarly, for some applications, the positive-displacement gas-driven motor option for power extraction makes better use of the level of mass air flow inherent in the free-piston engine, but this may not be true in all applications.

Although only preferred embodiments of the present invention are specifically disclosed and described above, it will be appreciated that many modifications, variations, substitutions, and equivalents are possible in light of the above teachings and within the purview of the appended claims, without departing from the spirit and intended scope of the invention.

What is claimed is:

1. An engine system comprising:

a) at least one combustor producing energetic hot gas, said combustor comprising:

a cylindrical casing closed at each end by a cylinder head, a piston assembly oscillating in the cylindrical casing, said piston assembly comprising two pistons fixedly attached to each other by a rigid connecting rod, a divider element centrally disposed within the cylindrical casing and penetrated by the rigid connecting rod through a central bore, thereby forming two separate cylinders within the cylindrical casing, with a piston operating in each, an air inlet communicating with each cylinder for admitting and controlling the flow of combustion air, a fuel inlet communicating with each cylinder to introduce fuel into and mix fuel with said combustion air;

at least one combustion chamber formed in each cylinder between each cylinder head and each piston head, at least one spark plug being mounted in the at least one combustion chamber of the at least one combustor;

a source of electric power for generating an electrical spark to initiate combustion during initial start-up until the oscillation of the piston assembly compresses the air/fuel mixture in the at least one combustion chamber to auto-ignition temperature, and an outlet in each cylinder for discharging and controlling the flow of energetic hot gas produced by the auto-ignition of the air/fuel mixture in the at least one combustion chamber;

b) a gas-driven motor to convert energy of the energetic hot gas produced in the at least one combustor to mechanical energy delivered to an external load via a rotating shaft, wherein said gas-driven motor is powered entirely by said energetic hot gas and further comprises:

a rotating element being driven by the energetic hot gas from the at least one combustor based on at least one of aerodynamic flow, pressure, and positive displacement forces, the rotating shaft connected to the rotating element to transmit a mechanical output power to the external load, an inlet for the energetic hot gas from the at least one combustor to be supplied to the gas-driven motor, and an outlet to discharge the energetic hot gas to the ambient atmosphere after expansion by the gas-driven motor;

c) at least one duct connecting the outlet of each cylinder of the at least one combustor to the gas-driven motor to supply the energetic hot gas from the at least one combustor to the gas-driven motor; and d) a rotary pre-compressor to deliver combustion air to the at least one combustor wherein said rotary pre-compressor is driven by a short shaft turned by an auxiliary gas-driven motor, said auxiliary gas-driven motor driven by a portion of the energetic hot gas produced by the at least one combustor.

2. The engine system of claim 1 wherein the at least one combustor further comprises, in each cylinder:

the air inlet further comprising an intake port disposed in a wall of the cylinder and axially adjacent to one face of the divider element;

an intake chamber bounded by the underside of the piston and one face of the divider element, and communicating with the intake port;

at least one lower transfer port communicating with the intake chamber;

at least one upper transfer port communicating with the combustion chamber; and at least one transfer passage connecting the at least one lower transfer port to the at least one upper transfer port;

whereby the oscillating motion of the piston forces at least one of combustion air and air/fuel mixture to pass through said at least one lower transfer port to said at least one upper transfer port, scavenging the combustion chamber once the energetic hot gas has been discharged through the outlet.

3. The engine system of claim 2 wherein the at least one upper transfer port in each cylinder is arranged substantially perpendicularly to a radius of the cylindrical casing centered on the outlet in each cylinder.

4. The engine system of claim 2 wherein the at least one combustor further comprises:

a source of compressed air; and at least one three-way valve communicating with the compressed air source and with each intake chamber;

whereby compressed air is alternately introduced into and vented from each intake chamber so as to move the piston assembly into a favorable position for initiating combustion in each combustion chamber.

5. The engine system of claim 1 wherein the at least one combustor further comprises:

the divider element having a diameter that is smaller than the bore of the cylindrical casing;

two restraining elements disposed within the cylindrical casing near each face of the divider element; and two compressible rings, one disposed between each restraining element and each face of the divider element;

whereby the divider element radially moves to the degree allowed by the flexible rings.

6. The engine system of claim 1 wherein the at least one combustor further comprises:

the rigid connecting rod such that said rigid connecting rod is hollow;

a radial passage in the interior of the divider element running from its circumference to its central bore;

a bushing introduced into the central bore of the divider element, wherein said bushing is split into two halves, with a toroidal space between the inner ends of each half;

a port in the wall of the rigid connecting rod;

a supply line for conveying a lubricating substance through the radial passage into the toroidal space between the inner ends of each half of the bushing, thence to the interior of the rigid connecting rod, and thence to each piston; and one or more ports in each piston to allow the lubricating substance to flow between each piston and the walls of each cylinder.

7. The engine system of claim 1 wherein the at least one combustor further comprises:

at least one permanent magnet or electromagnet fixedly attached to the rigid connecting rod; and at least one electrical coil fixedly attached to the divider element and oriented such that the rigid connecting rod and the at least one permanent magnet or electromagnet pass through said at least one electrical coil;

whereby the changing magnetic field generated by the motion of the at least one permanent magnet or electromagnet through the at least one electrical coil induces an electrical pulse to indicate piston position.

8. The engine system of claim 7 wherein the fuel inlet in the at least one combustor further comprises:

a source of pressurized fuel; and an electronic fuel injector disposed in the combustion chamber;

whereby the electrical pulse provides a timed signal that the electronic fuel injector uses to introduce fuel into, and mix fuel with, the combustion air before the air/fuel mixture is raised to ignition temperature.

9. The engine system of claim 7 wherein the at least one combustor further comprises an electronic control unit connected to the at least one electrical coil;

whereby the electronic control unit uses the electrical pulse to determine both frequency and phase of the harmonic motion of the piston assembly and to provide dynamic operating parameters to various engine systems and instruments.

10. The engine system of claim 9 wherein the electronic control unit sends a signal to pass electrical current through or apply an electrical load to the at least one electrical coil at appropriate intervals so as to obtain favorably phased relative oscillation rates of the piston assembly of the engine system.

* * * * *